US009554656B2

(12) United States Patent
Stjerna

(10) Patent No.: US 9,554,656 B2
(45) Date of Patent: Jan. 31, 2017

(54) SEPARATED POCKET SPRING MATTRESS WITH CUT THROUGH STRING, AND METHOD AND APPARATUS FOR PRODUCTION OF SUCH MATTRESS

(75) Inventor: Nils Eric Stjerna, Herrljunga (SE)

(73) Assignee: STJERNFJADRAR AB, Herrljunga (SE)

( * ) Notice: Subject to any disclaimer, the term of this patent is extended or adjusted under 35 U.S.C. 154(b) by 1611 days.

(21) Appl. No.: 10/579,069

(22) PCT Filed: Dec. 10, 2004

(86) PCT No.: PCT/SE2004/001832

§ 371 (c)(1),
(2), (4) Date: Feb. 9, 2007

(87) PCT Pub. No.: WO2005/055771

PCT Pub. Date: Jun. 23, 2005

(65) Prior Publication Data

US 2007/0124865 A1 Jun. 7, 2007

(30) Foreign Application Priority Data

Dec. 12, 2003 (SE) ..... 0303291

(51) Int. Cl.
*A47C 23/04* (2006.01)
*A47C 27/06* (2006.01)

(52) U.S. Cl.
CPC ..... *A47C 27/064* (2013.01); *A47C 27/063* (2013.01)

(58) Field of Classification Search
USPC ..... 5/720, 716, 655.8; 267/91, 80
See application file for complete search history.

(56) References Cited

U.S. PATENT DOCUMENTS

| | | | | |
|---|---|---|---|---|
| 1,455,847 | A * | 5/1923 | Meutsch | 5/720 |
| 2,048,979 | A * | 7/1936 | Trotta et al. | 5/655.8 |
| 2,615,180 | A | 10/1952 | Woller | |
| 4,578,834 | A * | 4/1986 | Stumpf | 5/720 |
| 4,986,518 | A * | 1/1991 | Stumpf | 267/91 |
| 5,319,815 | A * | 6/1994 | Stumpf et al. | 5/720 |
| 5,699,998 | A * | 12/1997 | Zysman | 267/189 |

FOREIGN PATENT DOCUMENTS

| | | |
|---|---|---|
| DE | 3738274 A1 | 5/1989 |
| DE | 40 26 502 | 6/1991 |
| DE | 44 35 771 | 4/1996 |
| DE | 200215963 UI | 10/2002 |
| EP | 1410744 A1 | 10/2003 |
| WO | WO 02/44077 A1 | 6/2002 |

* cited by examiner

*Primary Examiner* — David E Sosnowski
(74) *Attorney, Agent, or Firm* — Harness, Dickey & Pierce, P.L.C.

(57) ABSTRACT

A spring mattress with longitudinal strings comprising a plurality of interconnected coil springs (1) enclosed in covers (2) is described, wherein a plurality of such parallel strings are arranged side by side and interconnected by surface attachment between abutting surfaces. Furthermore, a slit is provided between at least two springs located adjacent to one another within the same string, which slit allows an increased interjacent separation distance (SA) to be formed between, said adjacent springs. Also described are a method and a device, respectively, for manufacturing a corresponding mattress.

32 Claims, 5 Drawing Sheets

SEPARATED POCKET SPRING MATTRESS WITH CUT THROUGH STRING, AND METHOD AND APPARATUS FOR PRODUCTION OF SUCH MATTRESS

TECHNICAL FIELD OF INVENTION

The present invention relates to a spring mattress of the kind wherein the springs are enclosed in covers, known as a pocket-spring mattress, and to a method and apparatus for manufacturing a mattress of this kind.

BACKGROUND OF THE INVENTION

One common technique of manufacturing spring mattresses is the one known as the pocket technique. According to this technique, the springs are enclosed in pockets, i.e. they are enclosed individually by a cover material. Owing to this arrangement, the springs become relatively resilient individually, such that each spring may flex separately without affecting adjacent springs, which increases the user's comfort, since the load will be distributed more evenly across the surface that receives the load.

One problem inherent in this type of mattresses is, however, that they are a great deal more expensive and more complex to manufacture than many other types of spring mattresses, since the manufacturing thereof requires large quantities of material and, in addition, many different joining and mounting steps. Furthermore, these mattresses are comparatively heavy and compact owing to the large quantity of material required, which in turn tends to make the mattresses relatively rigid.

Consequently, there is a need for a mattress which is easier and/or less expensive to manufacture, but which at the same time offers a comfort at least equivalent to that obtained in prior-art pocket-spring mattresses.

A previous solution to this problem is described in WO 02/44077 by the same applicant. According to this solution, springs located adjacent to one another within a string are spaced apart by a separation distance, which makes the mattress less compact and, thus, cheaper and easier to manufacture. The separation of the springs is obtained by providing double weld seams between the springs, said weld seams being parallel to one another and arranged at a certain distance from one another. Alternatively, the separation is achieved by a weld seam that is extended in the lengthwise direction of the string. Although this mattress offers a number of advantages compared with prior art, the manufacture thereof is still relatively complicated and expensive.

Moreover, a common problem associated with basically all pocket-spring mattresses, including the one described above, is that excess cover material accumulates at the top and bottom of the strings. This is a natural consequence due to the fact that the covers used are not adapted to the shape of the springs, while the thickness of the springs is such that they stretch the pocket-shaped covers locally. The accumulation of material in the upper and/or lower part results in non-desirable layers in the mattress, called false lofts, which have poor load-bearing capacity and are experienced as uneven and uncomfortable by the user. Furthermore, the accumulation of material implies a great waste of material, which of course is inefficient in terms of costs.

Another common problem associated with basically all pocket-spring mattresses is that the mattress is relatively compact, which impairs the circulation of air through the mattress. This is a disadvantage in that the user may perceive the mattress as being unnecessarily warm, in particular against the parts of the body that are in direct contact with the mattress. Furthermore, a continuous circulation of air ensures a better bed hygiene, which maintains the freshness of the bed for a longer period of time. It is true that the increased space between the springs as described above with reference to WO 02/44077 boosts the aeration of the mattress, but there is also in this mattress a need for an increased circulation of air. Moreover, a problem with this type of mattress is that residual ends of material are formed at the end of the strings, which besides being a disadvantage in terms of cost also makes the mattress unsymmetrical and formless.

It is known from U.S. Pat. No. 1,455,847 to provide slits between adjacent strings within the same string. However, this mattress is of another type than those described above, in which the strings are interconnected in a different manner. Today, the conventional way of interconnecting strings to form pocket mattresses is to interconnect them by gluing between abutting surfaces. In the mattress described in U.S. Pat. No. 1,455,847, the strings are instead interconnected by threading a connecting strip through the slits of the strings according to different patterns, this being the only purpose for which the slits are provided. Furthermore, U.S. Pat. No. 5,319,815 and DE 40 26 502, for example, disclose mattresses in which cuts are provided in the strings. In these mattresses, cuts are provided from the bottom or the top of the strings. In addition, the strings in these mattresses are not arranged in parallel with one another but crosswise, the cuts being intended to join together the cross-laid strings. DE 44 35 771 discloses a mattress in which the strings are provided with cuts in the middle of the string. Also in this case, however, the mattresses referred to have cross-laid strings, and the purpose of the cuts is to allow strings to be threaded through other strings.

OBJECT OF THE INVENTION

One of the objects of the present invention therefore is to provide a spring mattress of the kind defined in the introduction, and a method and an apparatus for manufacturing said mattress, by means of which the disadvantages referred to above are completely or at least partly removed.

This object is achieved in a spring mattress and by means of a method and an apparatus for manufacturing said mattress in the manner defined in the appended claims.

SUMMARY OF THE INVENTION

According to one aspect of the invention, a spring mattress with longitudinal strings is provided comprising a plurality of interconnected coil springs enclosed in covers. The mattress comprises a plurality of such parallel strings, which are arranged side by side and interconnected by surface attachment, such as gluing or welding, between abutting surfaces. Furthermore, a slit is provided between at least two springs located adjacent to one another within the same string, which slit allows an increased interjacent separation distance (SA) to be formed between said adjacent springs. Preferably, the slit is provided in such manner that it is completely enclosed between the upper and the lower part of the string, i.e. the slit begins and ends at a distance from the top and bottom edge, respectively, of the string.

Surface attachment here means all means and methods of joining together two surfaces, such as gluing, soldering, welding or the like.

The slit thus provided between adjacent springs allows the springs to be separated from one another causing the slit to open. The remaining material in the string still holds the string together, while the excess material in respectively the upper and lower part of the string is stretched out.

A number of advantages are thus obtained. The excess material in the upper and lower part of the string is stretched out, which eliminates the problem of so-called false lofts. In addition, a much better material economy in terms of cover material is achieved.

In relation to the prior-art mattress disclosed in WO 02/44077, the same advantages are obtained with springs that are spaced apart in the lengthwise direction of the strings. However, a much better material economy in terms of cover material is achieved, and considerably less cover material is needed to produce a string of the same length, having the same number of springs and the same separation spaces. The separation spaces between some springs make the mattress less compact and, consequently, fewer springs are required, the operation of enclosing the springs in covers is facilitated and so on. However, the separation spaces do not noticeably affect the comfort of the mattress. In fact, it has even been found that in some cases the increased distance between the springs adds to the individual resilience of the spring, which increases comfort, since each individual spring is able to support loads comparatively independently.

Owing to the efficient use of cover material and springs, the mattress is also relatively inexpensive and easy to manufacture.

Moreover, the slits, which during separation are opened to form holes, allow air to circulate transversely through the strings. Since the separation of the springs also results in air ducts being formed transversely of the mattress direction, a mattress with highly efficient air circulation is obtained overall.

According to a preferred embodiment, slits are provided between essentially all adjacent springs in essentially all the strings arranged in parallel. This allows the advantages described above to be obtained in all parts of the mattress.

However, it is equally possible for slits to be provided only between some of all adjacent springs of at least some of the strings to obtain zones with different properties across the mattress. In this manner, zones of different firmness can be easily provided in the lengthwise direction of the mattress, for example, or different halves of a double-bed mattress can have different properties.

Furthermore, the cover material is advantageously joined together on both sides along the slit to close the covers along the slit. This closing operation can be carried out after the slit has been formed, but preferably it is carried out before the slit is formed. In this case, the slit can be provided between two joining lines running side by side. Alternatively, the slit can be provided in the middle of an joining line, in particular if a slightly wider joining line is used. However, in the case of close cutting thin joining lines can also be used.

In a preferred embodiment, the springs are spaced apart by a separation distance exceeding about 10% of the diameter of the largest one of the spiral turns of the adjacent springs, and preferably exceeding 15%, most preferred 20%. This allows efficient manufacturing of the mattress, but does not affect the comfort of the mattress negatively. Furthermore, it is preferable that the separation distance is larger than 1 cm, and that the density of springs in the string direction, in strings in which slits are provided, is less than 15 springs per meter, and preferably less than 13 springs per meter.

According to another aspect of the invention, a method for manufacturing a spring mattress is provided comprising the steps of arranging coil springs in such manner that they are enclosed in covers in longitudinal strings, interconnecting a plurality of parallel strings side by side by surface attachment between abutting surfaces, and providing a slit between at least two springs located adjacent to one another within the same string, which slit allows an increased interjacent separation distance (SA) to be formed between said adjacent springs.

The above steps may be carried out essentially in any chosen order, although from the point of view of manufacturing it is preferred first to arrange the springs in strings, before joining together the cover material forming different strings.

The present method affords advantages corresponding to those described with reference to the first aspect of the invention.

According to a preferred embodiment, the step of providing coil springs in such manner that they are enclosed in covers in longitudinal strings comprises the partial steps of arranging a strip of a cover material so that it is folded over springs arranged in succession therebetween providing a longitudinal joining line, such as a weld or glue line, at the open end of the strip thus folded, and arranging, before or after providing the longitudinal joining line, at least one transverse joining line between adjacent springs in each pair of springs.

An efficient production is thus obtained, while at the same time the method of manufacturing can be easily combined with previously described production steps. The step of providing slits between springs located adjacent to one another within the same string is preferably carried out at the same time as, or directly after, the arranging of the at least one transverse joining line between said springs.

According to a third aspect of the invention, an apparatus is provided for manufacturing a spring mattress, comprising means for arranging coil springs enclosed in covers in longitudinal strings, means of interconnecting a plurality of parallel strings side by side by surface attachment between abutting surfaces, and means for providing a slit between at least two springs located adjacent to one another within the same string, which slit allows an increased interjacent separation distance (SA) to be formed between said adjacent springs.

The present apparatus affords advantages corresponding to those described above with reference to the first and the second aspect of the invention.

Additional features and advantages of the invention will be apparent from the claims and the following description of preferred embodiments.

DETAILED DESCRIPTION OF PREFERRED EMBODIMENTS

Figure 1:
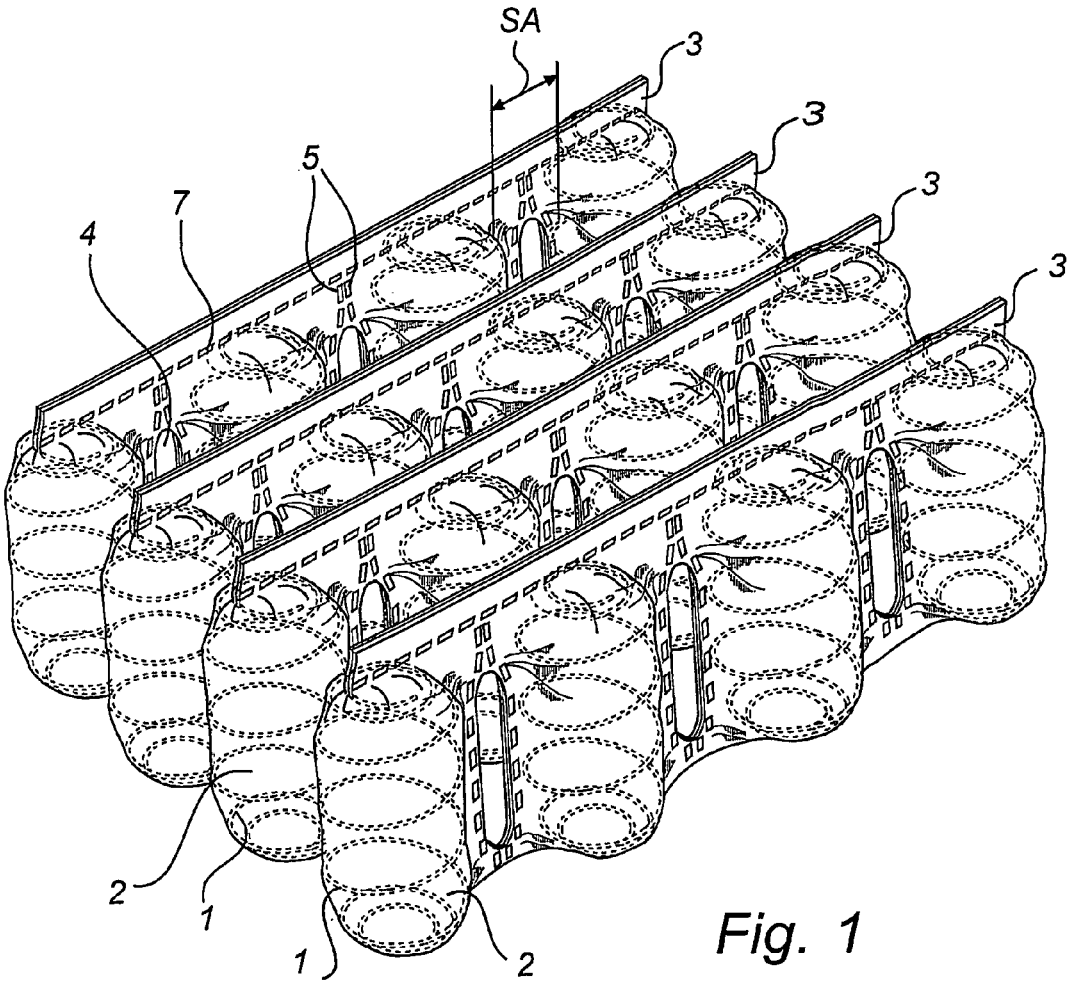
FIG. 1 is a perspective view of a part of a spring mattress designed in conformity with the invention.
Figure 2:
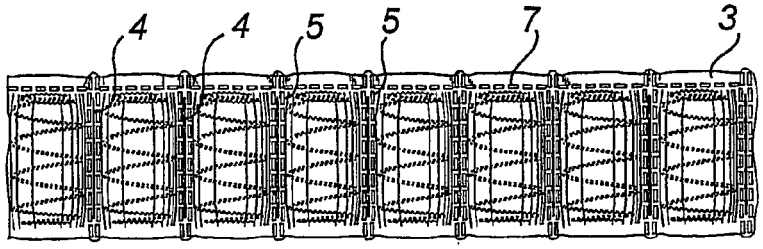
FIG. 2 is a side view of a string with enclosed springs to be used in a mattress in accordance with the invention, in a position before separation.

The invention will be described in the following for exemplifying purposes by way of embodiments and with reference to the accompanying drawings.

A spring mattress in accordance with the invention comprises a plurality of interconnected coil springs 1, which are enclosed in covers 2, as shown in FIGS. 1-4. Suitably, the cover is made from a preferably weldable textile fabric but other materials, such as various types of plastic material, could equally well be used. It is likewise possible to use non-weldable textile fabrics, such as cotton fabrics. Normally, strings 3 of interconnected, cover-enclosed coil springs are manufactured automatically, whereupon the strips are cut into suitable lengths and joined together side by side to form mattresses.

Preferably, the covers are dimensioned to ensure that the maximum enclosed height amounts to at least 3 cm and preferably to at least 5 cm.

Coil springs of many different sizes could be used in conjunction with the present invention, and in principle any desired spring size, large or small, may be used. Preferably, however, springs are used having a diameter of 2-10 cm, and most preferably a diameter of about 6 cm. Preferably, the springs comprise at least four spiral turns and preferably fewer than 10 spiral turns. In addition, it is an advantage to manufacture the springs from helically coiled wires having a thickness in the range between 0.5 and 3.0 mm and preferably a wire thickness in the range of 1.5 to 2.2 mm.

In the spring mattress in accordance with the invention a slit 4 is provided between at least two adjacent springs of at least one string. Preferably, the slit is provided in such manner that it is completely enclosed between the upper and the lower part of the string, this being achieved by the slit beginning a certain distance below the top of the string and ending a certain distance above the bottom of the string. This means that the string is still unbroken both at the top and at the bottom also after the slit has been formed. The slit allows the springs to be pulled apart, from the non-separated position shown in FIG. 2 to the separated position shown in FIG. 3, wherein an increased interjacent separation distance SA is formed between these adjacent springs. This will cause the slit to open, while the interconnecting remaining string material in the top and bottom part will be stretched out.

Preferably, this type of slit is provided between essentially all adjacent springs of the string, and in essentially all the strings arranged in parallel with one another.

The interjacent separation distance SA thus obtained preferably exceeds 10% of the diameter of the largest one of the spiral turns of the adjacent springs, and preferably it exceeds 15%, and most preferably exceeds 20%. In addition, the separation distance preferably exceeds 1 cm. These separation distances preferably are arranged between essentially all springs in the lengthwise direction of the mattress.

Furthermore, it is advantageous for the cover material to be joined on both sides along the slit to close the covers along the slit. This improves the ability of the covers to withstand opening and eliminates the risk of the springs making their way out of the pockets during use. This can be achieved by providing the strings with two joining lines 5, such as weld joints or glue lines, for the joining together of the cover material on both sides of the slit 4. The joining lines can be provided either before or after the providing of the slit.

Instead of several joining lines it is, however, also possible to have only one joining line, wherein the slit is provided exactly in the centre thereof so that the joining line still holds the cover material together on both sides of the slit.

The joining lines, comprising for example weld or glue lines, as described above, can be provided as continuous lines or as spot weld seams of different size arranged along lines. Other types of joints are possible too, such as one or several stitched seams.

The invention makes it possible to use less than 30 springs and preferably about 25 springs and most preferably about 22 springs in mattresses having a length in excess of 180 cm. It is also preferable that, in the mattresses in accordance with the invention, the density of springs in the lengthwise direction or directions, in which the separation distances are provided, is less than 15 springs per meter and preferably is less than 13 springs per meter.

Furthermore, in the mattress in accordance with the invention several strings are arranged in parallel, and interconnected side by side by surface attachment joints 6 of abutting surfaces. The surface attachment can be achieved by gluing, welding or the like.

In the manufacture of mattresses in accordance with the above, the following steps are carried out in any chosen order:

- arranging coil springs (1) in such manner that they are enclosed in covers (2) in longitudinal strings of cover material. This step in turn preferably comprises the partial steps of
  - arranging a strip of a cover material so that it is folded over springs arranged in succession therebetween,
  - providing a longitudinal weld 7 or glue line at the open end of the strip thus folded, and
  - arranging, before or after the arranging of the longitudinal weld/glue line 7, at least one transversal weld 5 or glue line between adjacent springs 1 in each pair of springs;
- interconnecting a plurality of parallel strings side by side by surface attachment between abutting surfaces; this step is preferably carried out by gluing and/or welding;
- providing slits between at least two adjacent strings within the same string, and pulling out the string to separate the springs.

Preferably, the step of providing the slits is carried out at the same time as, or directly after, the arranging of the at least one transverse weld/glue line between said springs.

Figure 4:
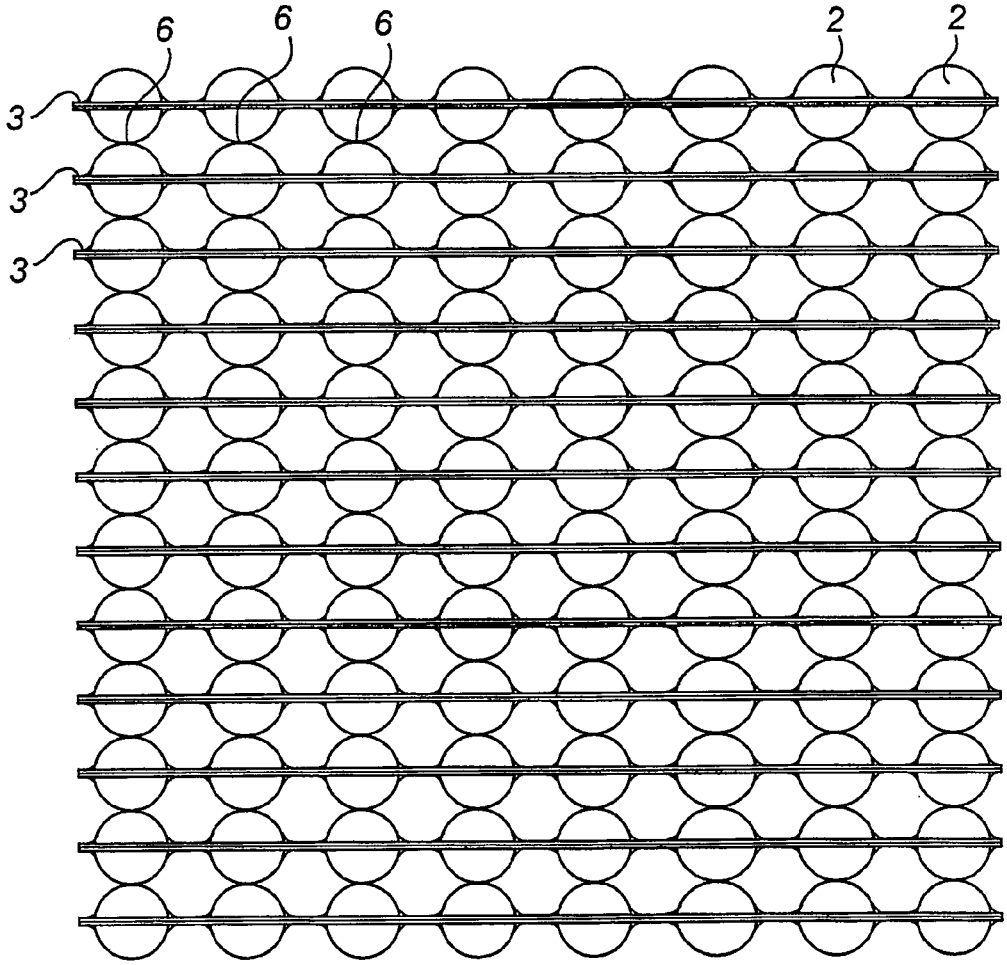
FIG. 4 is a plan view from above of a part of a mattress in accordance with one embodiment of the invention.
Figure 3:
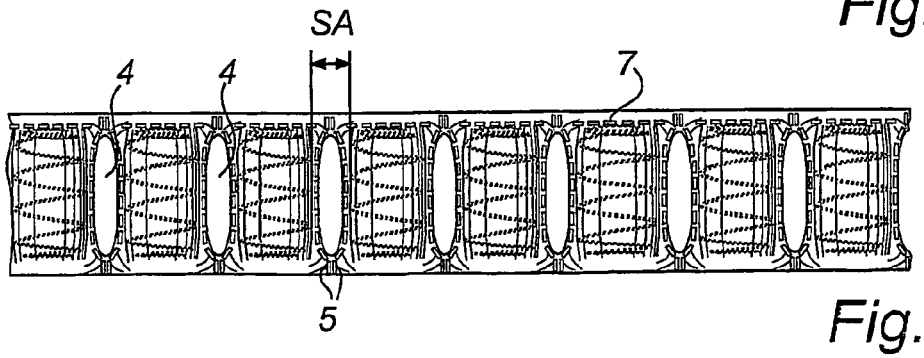
FIG. 3 shows the string of FIG. 2, but in a position where the string has been separated.

As already mentioned, the covers comprising springs are preferably arranged in successive rows, whereupon such rows are attached to one another side by side by surface attachment as indicated in FIG. 4. Preferably, the rows are attached to one another in 2-3 vertically spaced attachment points opposite the associated spring. A larger or smaller number of attachment points could of course also be used. It is likewise possible to use one long attachment line extending essentially in parallel with the longitudinal direction of the springs instead of several, shorter attachment points. It is likewise possible to join together the strings by means of a string of glue or the like extending in the direction of extension of the strips. The interconnection of rows side by side in succession could be effected by welding or gluing, as mentioned previously. However, this interconnection can be achieved using other alternative forms of surface attachment, such as clamps, Velcro tapes or some other suitable joining-together method.

By joining-together the strings in this way opposite the springs in the respective string, the separation distances will be positioned in alignment with one another, as indicated in the embodiment shown in FIG. 4. This position is the preferred one, although it is likewise possible to arrange the strings in such a manner that the springs will be positioned offset relative to one another. In the latter case, the springs as a whole may be arranged, if desirable, more densely across the mattress than is the case in conventional pocket-spring mattresses.

It is also possible to use different separation distances in different zones or areas of the mattress and to use for example larger separation distances in areas that in normal use of the mattress are less exposed to load, and smaller separation distances in areas exposed to more heavy loads. This can be controlled by determining between which springs slits are provided, how long the slits are, where on the strings the slits are provided, how the strings are joined together, etc.

Figure 9:
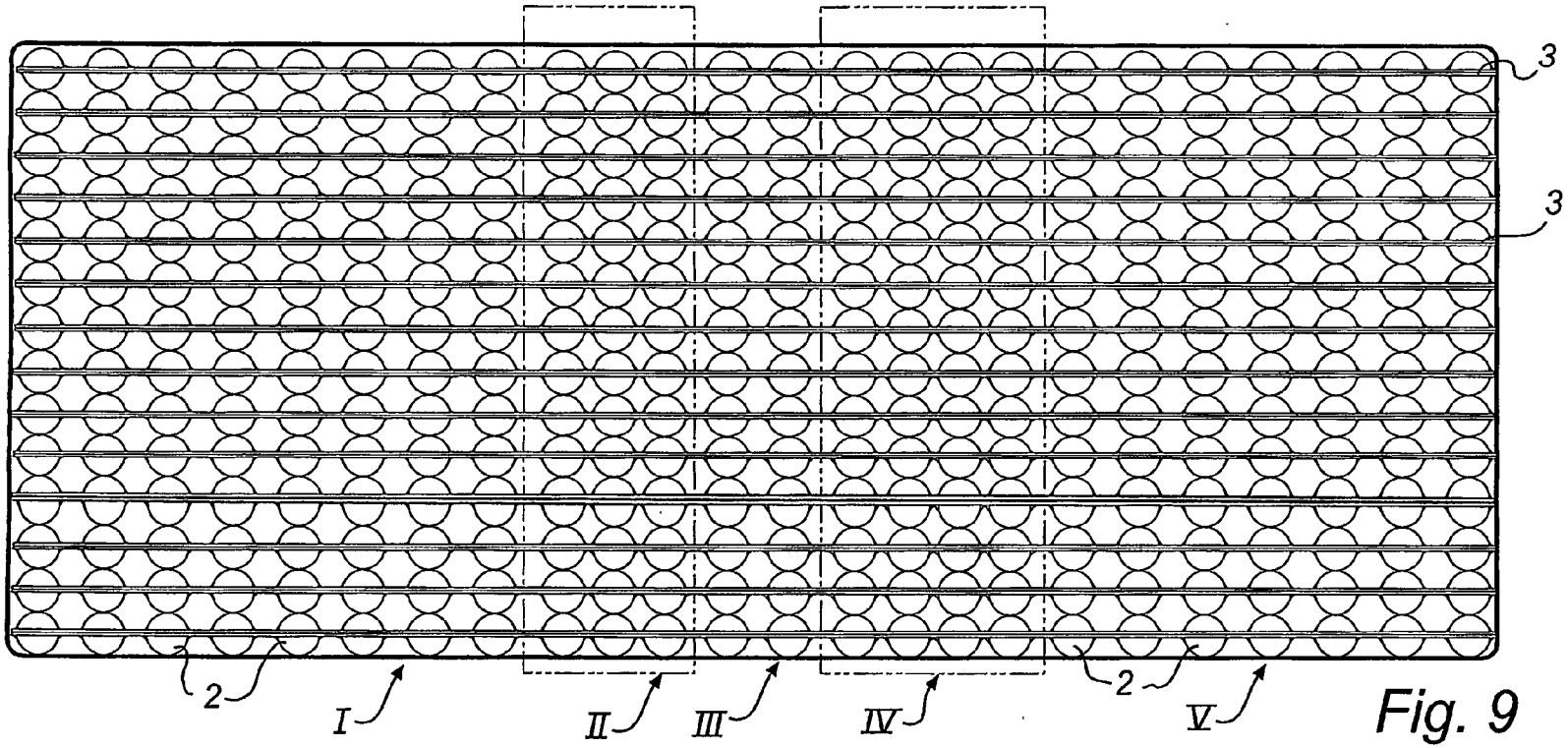
FIG. 9 is a plan view from above of a mattress comprising different zones in accordance with one embodiment of the invention.
Figure 10:
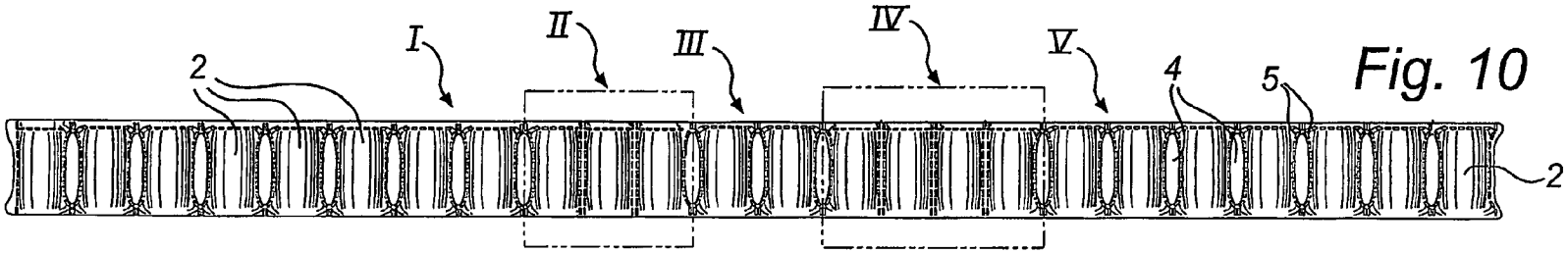
FIG. 10 is a side view of the mattress in FIG. 9.

One example of a mattress comprising different zones is shown in FIGS. 9 and 10. In this example, the mattress comprises several different zones in the lengthwise direction thereof. In a first zone I located at the head end of the mattress, the strings are cut through between the springs, in the manner described in detail above. In normal use, this zone is subjected to the load of the user's upper body, from the waist up. In a second zone II, the strings are not cut through. This zone corresponds to the curve of the user's back. Thereafter, a short zone III is provided in which the strings are cut trough. This zone corresponds to the buttocks of the user. Next, another zone IV in which the strings are not cut through is provided, which zone corresponds to the thighs of the user. Finally, the foot end of the bed comprises a large, cut-through zone V, which corresponds to the legs of the user from the thighs down. This bed offers support for the curve of the user's back and the thighs, while allowing the other body parts to sink deeper into a softer mattress. In this way, a more comfortable mattress is obtained, in which the loads on all parts of the body are more evenly distributed.

However, many other variants of zone division are conceivable. It is possible, for example, to divide the mattress into a larger or smaller number of zones in the lengthwise direction of the mattress. One example is using only three zones. Furthermore, it is possible to divide the mattress into zones also in the latitudinal direction, by interconnecting strings with non-identical cuts between the springs. In this connection, the springs may also comprise different numbers of springs. This allows, for example, a mattress to be obtained which is softer in the middle (with cut-through strings) and harder towards the edges (with less cut-through strings). Moreover, when manufacturing double beds, for instance, non-homogeneous strings may be used in the different mattress halves, thus to better adapt the mattress for the use of two persons with different needs and desires.

It is possible, of course, to obtain corresponding zone divisions using mattresses that are instead formed of transversal strings and not of the longitudinal strings described above.

An apparatus for manufacturing a spring mattress as described above and for carrying out the above-related method may comprise:

- means for arranging coil springs 1 enclosed in covers 2 in longitudinal strings 3 of a cover material. Means of this kind are previously known within the field and have been used previously to manufacture pocket-spring mattresses.
- means for interconnecting a plurality of parallel strings side by side by surface attachment between abutting surfaces. Means of this kind are also previously well-known within the field and have previously been used to manufacture pocket-spring mattresses.
- means for providing a slit between at least two springs located adjacent to one another within the same string, which slit allows an increased interjacent separation distance (SA) to be formed between said adjacent springs. Means of this kind have not previously been used in this type of apparatus and will be described in greater detail below.

The means for arranging coil springs in such manner that they are enclosed in covers advantageously comprises means for arranging a strip of a cover material 2 so that it is folded over springs 1 arranged in succession therebetween, means for arranging a joining line 7, such as a weld or glue line, at the open end of the strip thus folded, and means for arranging at least one transverse joining line 5, such as a weld or glue line, between pairs of adjacent springs of the strings.

Figure 5:
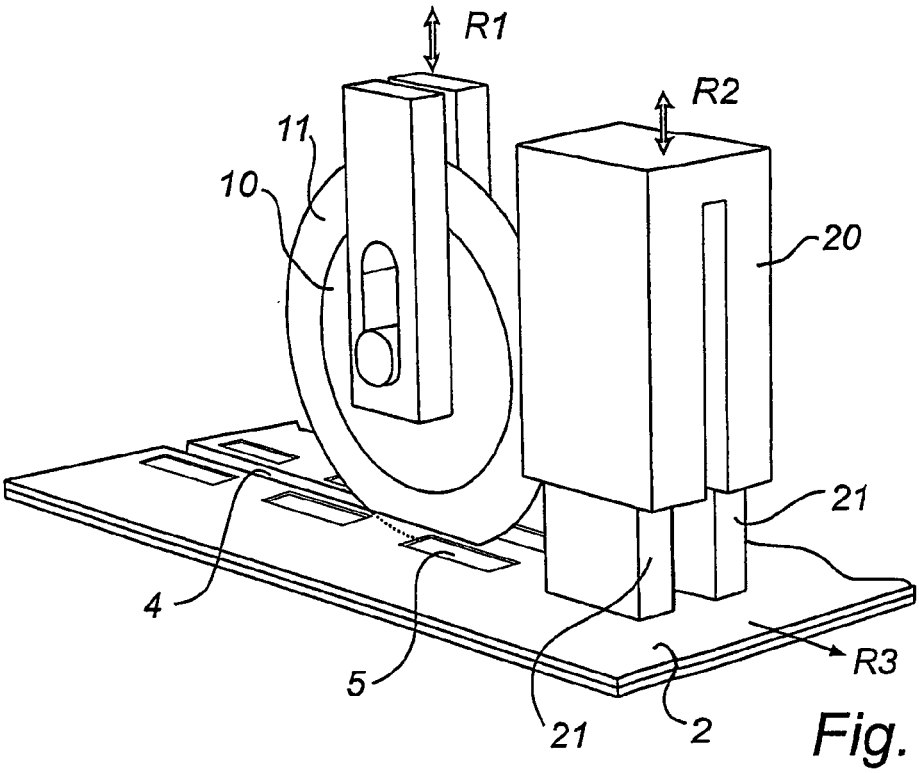
FIG. 5 is a perspective view of a part of an apparatus, according to a first embodiment, for manufacturing a mattress in accordance with the invention.

The means for arranging slits can consist of a cutting tool 10 arranged to be moveable towards the cover material, as shown in FIG. 5. In this case, the cutting tool consists of a rotating cutting tool, comprising a circular cutting edge, which can be rotated during operation. Furthermore, the cutting tool can be moveable in a direction towards and away from a working table on which the cover material 2 is positioned during use, as indicated by the arrow R1. Preferably, the cutting tool is arranged directly adjacent the means for arranging transverse joining lines 5. Said means may consist, for example, of welding equipment 20 for ultrasonic welding, with two welding elements 21. The welding equipment is preferably moveable in the same way as the cutting tool, but independently thereof, as indicated by the arrow R2. This allows the welding equipment to be lowered towards the cover material to create two parallel spot weld lines 5, and the cutting tool to be lowered towards the cover material to create a slit 4 therebetween, while at the same time the cover material is displaced relatively to the welding equipment and the cutting tool, as indicated by the arrow R3. However, it is equally possible instead to cause the welding equipment 20 and the cutting tool 10 to be displaced in the direction R3 and the cover material to remain still.

In this embodiment, the welding equipment tools the cover material first, and only thereafter is the slit formed by the cutting tool. The opposite approach is also possible, i.e. the slit is formed first, and only thereafter are welds provided along the edges of the slit sides.

Figure 6:
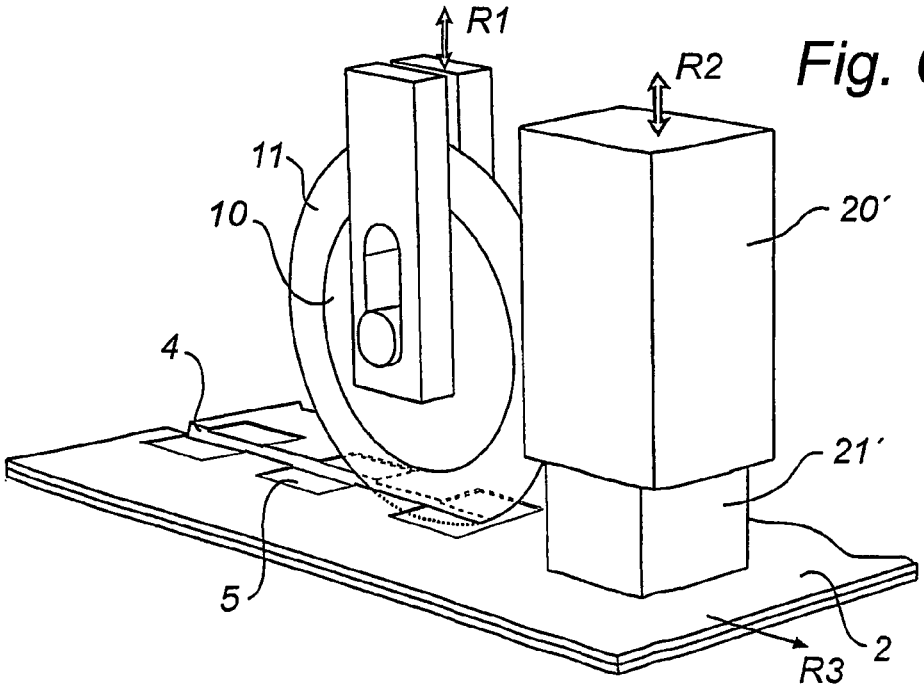
FIG. 6 is a perspective view of a part of an apparatus, according to a second embodiment, for manufacturing a mattress in accordance with the invention.

As an alternative to the embodiment described above with reference to FIG. 5, a welding equipment 20' which comprises only one welding element 21' may be used, as shown in FIG. 6. As a result thereof, only one joining line 5 is formed, which is separated by the slit 4. In this case, it is an advantage to provide a slightly wider joining line, to make sure that a satisfactory interconnection is obtained on both sides of the slit. In other respects, the same arguments as above apply regarding the use of the equipment and the interrelation between the welding equipment, cutting tool and cover material.

Figure 7:
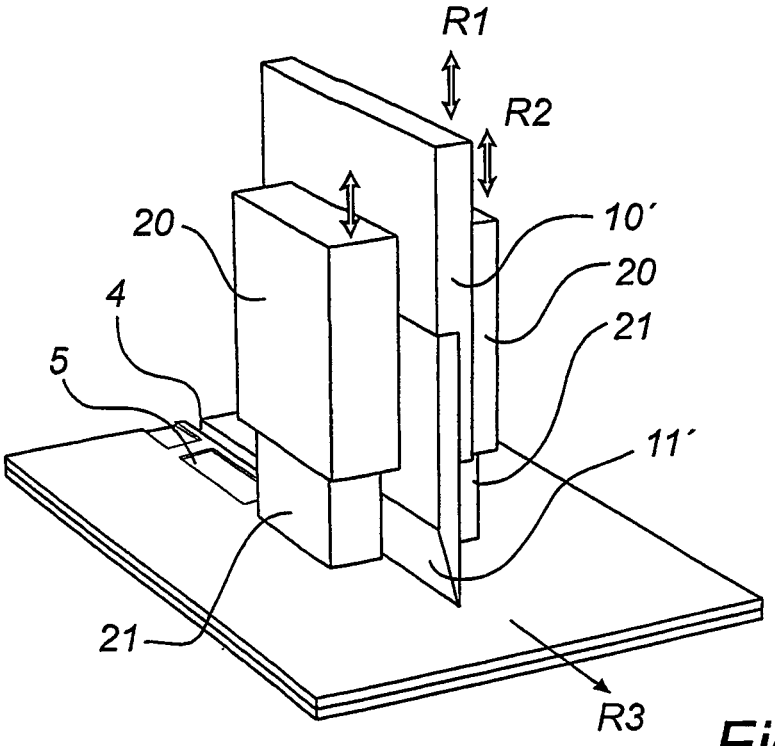
FIG. 7 is a perspective view of a part of an apparatus, according to a third embodiment, for manufacturing a mattress in accordance with the invention.

Instead of a rotating cutting tool, as described above with reference to FIGS. 5 and 6, a non-rotating tool 10 may be used, as shown in FIG. 7. This tool is movable towards and away from the cover material in the way described above. The non-rotating tool may have a flat cutting edge 11', as shown in FIG. 7, but other designs are also conceivable. For instance, the cutting edge may be concave, convex, serrated, corrugated or the like. Moreover, the cutting edge can be arranged parallel to the cover material, as shown in FIG. 7, or more or less tilted relatively to said plane. The cutting tool may also be arranged before or after the welding equipment. In the case where multiple welding elements are used it is, however, also possible to arrange the cutting tool at the same level as the welding elements and between them, as shown in FIG. 7. This allows a very compact design of the apparatus.

Figure 8:
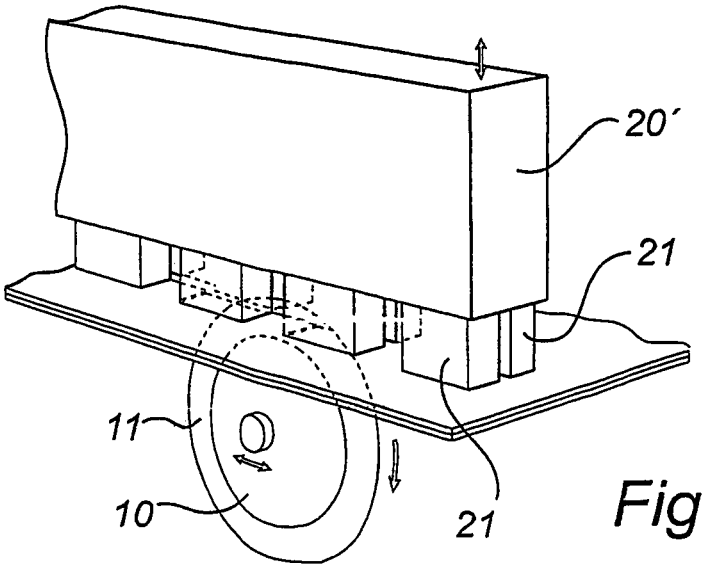
FIG. 8 is a perspective view of a part of an apparatus, according to a fourth embodiment, for manufacturing a mattress in accordance with the invention.

Furthermore, it is possible to arrange the cutting tool 10 and the joining tool 20' on opposite sides of the cover material, as shown in the working example in FIG. 8. More space is thus available for each tool and, consequently, their manufacture and use is simplified.

As described above, it is possible to use joining tools, such as welding means, which are displaceable along a line and, thus, are continuously or intermittently activated to form the joining line. However, it is also conceivable to use joining tools 20' whose extension in the longitudinal direction corresponds to that of the joining line. One example of such a tool is shown schematically in FIG. 8. In an embodiment of this kind, the joining tool does not have to be displaced along the joining line, but only up and down to "stamp" the joining line between the springs. This operation can be carried out considerably faster, thus allowing the rate of production to be increased.

The apparatuses adapted to cut slits according to the above description can be integrated with most of the prior-art manufacturing equipment for manufacturing pocket-spring mattresses. It is also conceivable, however, to arrange the cutting tool separately from the rest of the manufacturing equipment. Thus, the welding equipment can be located before the cutting equipment in the direction of travel of the strings, wherein detecting means can be used to detect the joining lines prior to the cutting operation. Different types of detecting means are conceivable, such as mechanical means that detect the position of the springs on both sides of the weld seam, optical means that identify the weld seam in the material, etc.

The mattress in accordance with the invention offers resilience properties equivalent to those achieved in conventional pocket-spring mattresses, providing the same firmness, comfort and so on. Possibly somewhat harder springs than normal may be used to increase the mattress firmness. Alternatively, the same effect can be achieved, however, in other ways, for example by means of springs that when being enclosed are subjected to a higher pre-loading tension.

The invention has been described above with reference to one embodiment. However, several variants of the invention are possible many of which have already been discussed above. For example, other cover materials may be used as also differently sized springs, and so on. Such closely related variants should be considered to be within the scope of protection of the invention as defined in the appended claims.

The invention claimed is:

1. A spring mattress with longitudinal strings, the spring mattress comprising:

a plurality of interconnected coil springs enclosed in covers, and a plurality of parallel strings arranged side by side and interconnected by a surface attachment between abutting surfaces of adjacent strings, wherein a slit is provided between at least two coil springs located adjacent to one another within the same string, the slit in combination with the surface attachment allowing an increased interjacent separation distance to be formed between said adjacent coil springs.

2. The spring mattress as claimed in claim 1, wherein the slit is provided such that the slit is completely enclosed between an upper and a lower part of the string.

3. The spring mattress as claimed in claim 1, wherein the slit is provided between all adjacent coil springs in all the strings arranged in parallel.

4. The spring mattress as claimed in claim 1, wherein the slit is provided only between some of the adjacent coil springs of at least one string to obtain zones with different properties across the mattress.

5. The spring mattress as claimed in claim 1, wherein the covers are joined together on both sides along the slit to close the covers along the slit.

6. The spring mattress as claimed in claim 1, wherein the surface attachment configured to interconnect the strings includes at least one of gluing and welding.

7. The spring mattress as claimed in claim 1, wherein the separation distance exceeds about 10% of the diameter of the largest spiral turn of the adjacent coil springs.

8. The spring mattress as claimed in claim 1, wherein the separation distance exceeds 1 cm.

9. The spring mattress as claimed in claim 1, wherein a spring density of the spring mattress along a direction of slits in a string is less than 15 springs per meter.

10. The spring mattress as claimed in claim 1, wherein the covers are made from a textile fabric that can be welded.

11. A method of manufacturing a spring mattress, the method comprising:

arranging coil springs enclosed in covers in longitudinal strings, and interconnecting a plurality of parallel strings side by side by a surface attachment between abutting surfaces of adjacent strings, and providing a slit between at least two coil springs located adjacent to one another within the same string such that the slit in combination with the surface attachment allows an increased interjacent separation distance to be formed between the adjacent coil springs.

12. The method as claimed in claim 11, wherein the slit is provided such that the slit is completely enclosed between an upper and a lower part of the string.

13. The method as claimed in claim 11, further comprising joining together a cover material on both sides along the slit to close the covers along the slit, wherein the cover material is joined before providing the slit.

14. The method as claimed in claim 11, wherein the plurality of parallel strings are interconnected side by side by at least one of gluing and welding.

15. The method as claimed in claim 11, wherein arranging the coil springs further comprises:

arranging a strip of a cover material such that it is folded over the coil springs arranged in succession therebetween, providing a longitudinal joining line at the open end of the folded strip, and arranging, before or after providing the longitudinal joining line, at least one transverse joining line between adjacent pair of coil springs.

16. The method as claimed in claim 15, wherein the slit between adjacently located coil springs is provided at the same time as or directly after arranging the at least one transverse joining line.

17. An apparatus for manufacturing a spring mattress, the apparatus comprising:

means for arranging coil springs such that the coil springs are enclosed in covers in longitudinal strings, and means for interconnecting a plurality of parallel strings side by side by surface attachment between abutting surfaces of adjacent strings, wherein the apparatus further includes means for providing a slit between at least two coil springs located adjacent to one another within a same string such that the slit in combination with the surface attachment allows an increased interjacent separation distance to be formed between the adjacent coil springs.

18. The apparatus as claimed in claim 17, wherein the means for providing the slit between at least two coil springs located adjacent to one another within the same string are configured to arrange the slit such that the slit is completely enclosed between an upper and a lower part of the string.

19. The apparatus as claimed in claim 17, further comprising means for joining together a cover material on both sides along the slit, to close the covers along the slit.

20. The apparatus as claimed in claim 17, wherein the means for interconnecting a plurality of parallel strings side by side by surface attachment between abutting surfaces are configured to effect said interconnection by at least one of gluing and welding.

21. The apparatus as claimed in claim 17, wherein the means for arranging the coil springs comprise:

means for arranging a strip of a cover material so that the cover material is folded over the coil springs arranged in succession therebetween, means for arranging a longitudinal joining line at an open end of the folded strip, and means for arranging at least one transverse joining line between each pair of adjacent springs.

22. The apparatus as claimed in claim 21, wherein the means for providing the slit is a cutting tool configured to move in a direction of the cover material.

23. The apparatus as claimed in claim 22, wherein the cutting tool is arranged adjacent to the means for arranging the at least one transverse joining line between each adjacent pair of springs and wherein the cutting tool is configured to operate jointly with the means for arranging the at least one transverse joining line.

24. The spring mattress as claimed in claim 1, wherein the separation distance exceeds about 15% of the diameter of the largest spiral turn of the adjacent coil springs.

25. The spring mattress as claimed in claim 1, wherein the separation distance exceeds about 20% of the diameter of the largest spiral turn of the adjacent coil springs.

26. The spring mattress as claimed in claim 1, wherein a spring density of the spring mattress along a direction of slits in a string is less than 13 springs per meter.

27. The spring mattress as claimed in claim 1, wherein each string of the plurality of parallel strings includes the plurality of coil springs enclosed in a continuous cover.

28. The spring mattress as claimed in claim 1, wherein the slit is a cut out opening in the enclosing cover of the string and at least a portion of the enclosing cover surrounding the slit is unbroken and continuous.

29. The method as claimed in claim 11, further comprising:

interconnecting each string of the plurality of parallel strings including the coils springs enclosed in a continuous cover.

30. The method as claimed in claim 11, further comprising:

providing the slit as a cut out opening in the enclosed cover of the string around at least a portion of the enclosing cover surrounding the slit, the portion of the enclosing cover surrounding the slit being unbroken and continuous.

31. The apparatus as claimed in claim 17, wherein the means for arranging coil springs arrange the coil springs such that the coil springs are enclosed in a continuous cover.

32. The apparatus as claimed in claim 17, wherein the means for providing the slit provide a slit that is a cut out opening in the enclosing cover of the string and at least a portion of the enclosing cover surrounding the slit is unbroken and continuous.

* * * * *